United States Patent [19]

Hannan

[11] Patent Number: 4,791,429

[45] Date of Patent: Dec. 13, 1988

[54] MULTIMODE OMNIANTENNA WITH FLUSH MOUNT

[75] Inventor: Peter W. Hannan, Smithtown, N.Y.

[73] Assignee: Hazeltine Corporation, Greenlawn, N.Y.

[21] Appl. No.: 48,358

[22] Filed: May 11, 1987

[51] Int. Cl.[4] ..... H01Q 5/00

[52] U.S. Cl. ..... 343/770; 343/725; 343/789; 343/814

[58] Field of Search ..... 343/705, 708, 770, 771, 343/789, 799, 814, 853, 857, 858, 725

[56] References Cited

U.S. PATENT DOCUMENTS 2,838,754 6/1958 Bickmore ..... 343/770

4,208,660 6/1980 McOwen, Jr. ..... 343/789

4,451,832 5/1984 Stites ..... 343/858

*Primary Examiner*—William L. Sikes

*Assistant Examiner*—Doris J. Johnson

*Attorney, Agent, or Firm*—E. A. Onders

[57] ABSTRACT

A central aperture provides at least two radiation pattern modes. A second aperture concentric with the central aperture provides at least two radiation pattern modes. A first feed system excites the central aperture and a second feed system excites the concentric aperture. Circuit means associated with the second feed system provides an auxiliary excitation to the concentric aperture which results in optimizing the radiation pattern obtained during excitation of the central aperture.

29 Claims, 3 Drawing Sheets

FIG. 4A
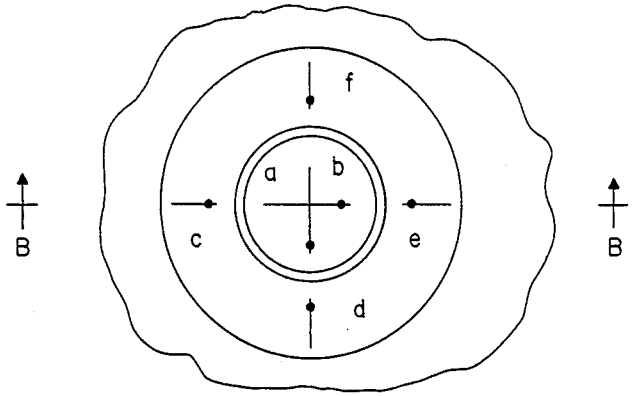
FIG. 4B
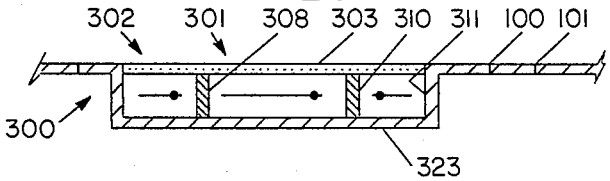
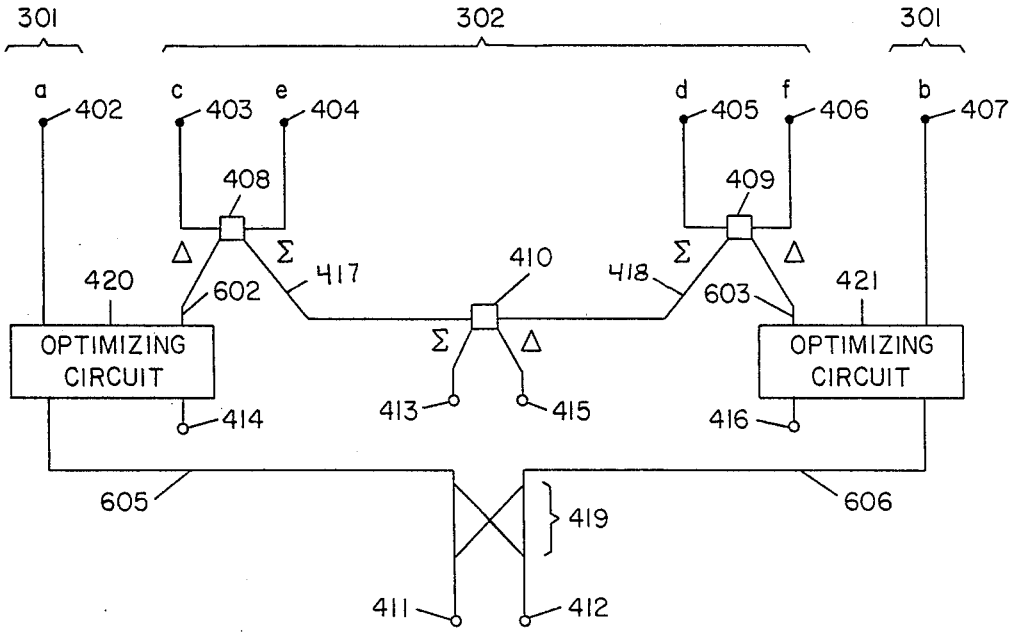
FIG. 5

PRIOR · ART

MULTIMODE OMNIANTENNA WITH FLUSH MOUNT

BACKGROUND OF THE INVENTION

1. Field of the Invention

The invention relates generally to aircraft antennas and, in particular, a multimode, omnidirectional antenna which may be used in a flush-mounted configuration on a high performance aircraft in order to avoid the drag typically resulting from protruding antenna systems.

2. Description of the Prior Art

Flush mounted antennas are in general use. When a number of radio systems on diverse frequencies are used, a plurality of flush mounted systems can become difficult to accommodate, particularly on existing aircraft. Also, when new radio systems are planned for addition to an existing aircraft with a flush mounted antenna system, it would be desirable to replace such an antenna system with another antenna system capable of handling a variety of frequencies with a variety of radiation pattern modes.

SUMMARY OF THE INVENTION

It is an object of this invention to provide a flush mounted antenna having multiple modes of operation so that it can be associated with a number of radio systems on diverse frequencies.

It is another object of this invention to provide a flush mounted antenna having multiple apertures.

It is another object of this invention to provide a flush mounted antenna providing omnidirectional coverage.

The antenna according to the invention is a flush mounted, multimode system using a plurality of apertures. A first aperture means provides at least two radiation pattern modes. A second aperture means concentric with the first aperture mean provides at least two radiation pattern modes. A first feed system excites the first means and a second feed system excites the second means. The invention also includes circuit means associated with the second feed system to provide an auxiliary excitation to the second aperture means. As a result, the radiation pattern obtained during excitation of the first aperture means is optimized.

For a better understanding of the present invention, together with other and further objects, reference is made to the following description, taken in conjunction with the accompanying drawings, and its scope will be pointed out in the appended claims.

BRIEF DESCRIPTION OF THE DRAWINGS

FIG. 4A is a top plan view of another embodiment of an antenna according to the invention having a central circular aperture and a concentric annular aperture.

FIG. 4B is a sectional view taken along line BB of the antenna shown in FIG. 4A.

FIG. 5 is a circuit diagram of a feed system according to the invention including circuit means to provide the auxiliary excitation.

DETAILED DESCRIPTION OF THE INVENTION

Figure 1:
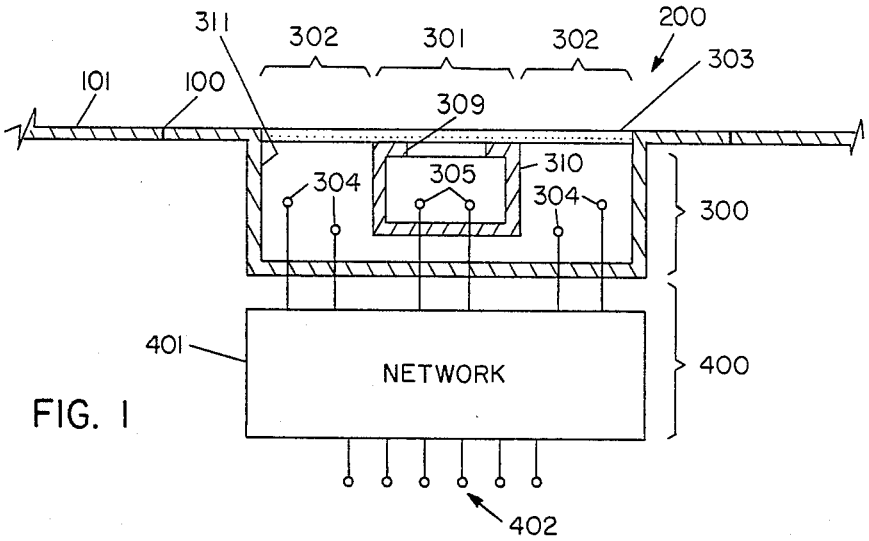
FIG. 1 is a stylized view, partially in section, of the flush mounted, multimode antenna according to the invention showing a central aperture and a concentric aperture.

FIG. 1 is a stylized representation of an antenna according to the invention in a flush mount. In the preferred embodiment of the invention, the antenna is flush mounted with a metallic surface such as an aircraft skin. Opening 100 would be cut into aircraft skin 101 so that antenna 200 could be mounted therein. The antenna according to the invention has two basic parts: the radiating structure 300 and the feed system 400.

The radiating structure 300 is flush mounted in the aircraft skin 101 and includes a central aperture 301 and a concentric aperture 302. A dielectric window 303 may be mounted in these apertures flush with the metal surface of the aircraft 101. The exact configuration of central aperture 301 and concentric aperture 302 will be discussed in greater detail below. Radiating structure 300 also includes concentric exciters 304 and central exciters 305. These exciters are supplied with radio frequency power from feed system 400 and provide the radiation which antenna 200 emits. The exciters are connected through a network 401 to mode ports 402. As will be described in greater detail below, the various mode ports 402 provide various antenna patterns which account for the multimode operation of the invention.

Figure 2A:
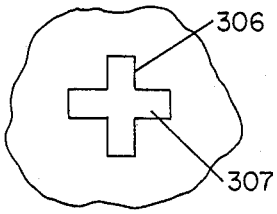
FIGS. 2A, 2B and 2C illustrate plan view of a crossed aperture, a circular aperture and a square aperture, respectively, which are central apertures which may be used as part of the antenna according to the invention.
Figure 2B:
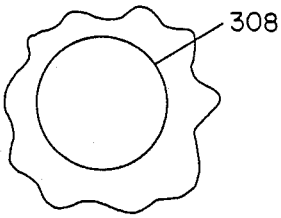
Figure 2C:
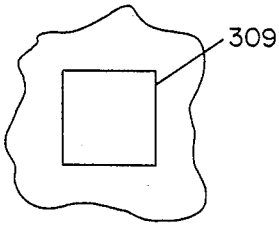

FIGS. 2A, 2B and 2C illustrate various central apertures 301 which may be employed with the invention. The crossed aperture of FIG. 2A includes a vertical slot 306 which is perpendicular to and bisects a horizontal slot 307. The circular aperture of FIG. 2B includes a circular opening 308 which defines the central radiating aperture. The square aperture of FIG. 2C is defined by a square opening 309. FIG. 1 is also illustrated with this rectangular opening 309. However, any central aperture such as illustrated in FIGS. 2A or 2B, or any other equivalent aperture well known in the prior art may be used as part of central aperture 301.

Figure 3A:
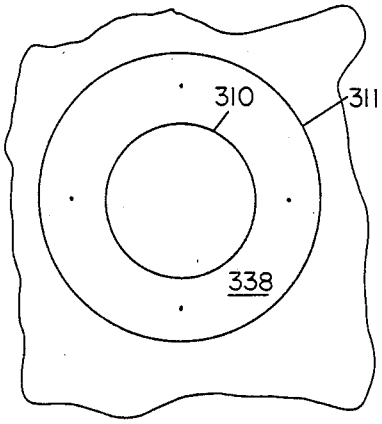
FIGS. 3A, 3B and 3C illustrate a plan view of an annular aperture, a square aperture, and a box array of four apertures, respectively, which may be used as the concentric aperture for the antenna according to the invention.
Figure 3B:
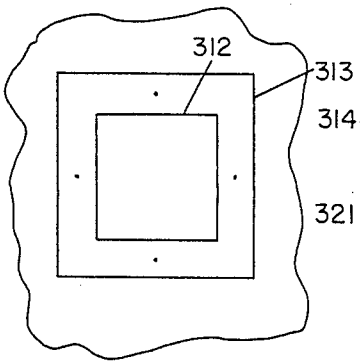
Figure 3C:
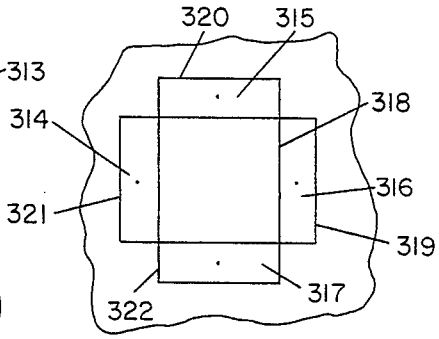

The aperture of FIG. 3A is defined by an inner circular border 310 and an outer circular border 311 and results in annular aperture 338. This annular aperture is also illustrated in FIG. 1. However, the invention contemplates that any concentric aperture may be employed as part of the invention such as the square aperture of FIG. 3B or the box array of four apertures shown in FIG. 3C. In addition, any other concentric aperture well known in the prior art may be used as part of the concentric aperture 302 of the invention. The square aperture of FIG. 3B is defined by an inner square border 312 and an outer square border 313. The box array of FIG. 3C includes four apertures 314, 315, 316 and 317. The inner surface of each aperture is defined by square border 318 and the outer surfaces defined by the outer border comprising surfaces 319, 320, 321 and 322.

FIG. 4A is a top plan view of another embodiment of an antenna according to the invention having a central circular aperture as illustrated in FIG. 2B and a concentric annular aperture as illustrated in FIG. 3A. FIG. 4B is a cross-sectional view taken along the lines B-B of FIG. 4A. In this embodiment, the central aperture 301 extends all the way to the base of the radiating structure 300 and is in contact with the plane 323. This is in contrast to FIG. 1 wherein central aperture 301 is generally shown to have a base independent from the base of the concentric aperture. This embodiment is also shown in a flush mount configuration wherein opening 100 is cut into aircraft surface 101 so that the radiating structure 300 may be located therein. The structure is covered with a flush dielectric window 303 and includes a plurality of exciters a, b, c, d, e and f within the radiating structure 300. Exciters a and b are located within the central aperture 301 and are connected to a network (not shown) for supplying rf power. Exciters c, d, e and f are located in concentric aperture 302 and are also supplied by a network (not shown) which supplies rf power.

Based on reciprocity, the antenna 200 according to the invention may function in the transmit or receive mode. For simplicity and consistency, the invention is described in the transmit mode. However, one skilled in the art will readily appreciate and understand the application of the invention in the receive mode as well.

FIG. 5 illustrates one embodiment of network 401 according to the invention. Exciters a, b, c, d, e and f are associated with output ports 402–407. Hybrid junctions 408, 409 and 410 form a part of network 401. Each junction is a standard hybrid junction well known in the prior art such as a sum/difference junction. Input ports 413 and 415 provide signals to the sum and difference ports respectively of hybrid 410. Transmission line 602 along with transmission line 417 provide inputs to the difference and sum ports respectively of hybrid 408. Transmission line 603 along with transmission line 418 provide inputs to the difference and sum ports respectively of hybrid 409. Input ports 411 and 412 are interconnected by 3 db directional coupler 419 and provide outputs to output ports 402 and 407 via transmission lines 605 and 606. The optimizing circuits and their effect will be discussed below.

The invention is referred to as multimode omniantenna because by selecting various input ports, different radiation patterns result. In particular, providing rf power to input ports 411 or 412 provides circularly polarized radiation in the zenith direction. This results from the fact that the coupler 419 provides equal power in a 90° phase relation to output ports 402 and 407. As a result, the crossed exciters a and b supply rf excitation to the central aperture 301 resulting in circularly polarized radiation in the zenith direction. Opposite senses of circular polarization are provided from ports 411 and 412. In the horizon direction, the radiation is vertically polarized and is omnidirectional. The zenith and horizon directions are defined here for an antenna mounted on top of the fuselage of an aircraft in level flight.

Providing rf power to input port 413 results in vertically polarized, omnidirectional radiation in the horizon direction. This is because hybrid junctions 410, 408 and 409 provide equal powers that are in phase at output ports 403, 404, 405 and 406. As a result, exciters c, d, e and f supply rf excitation to the concentric aperture 302 resulting in vertically polarized omnidirectional radiation in the horizon direction. A null of radiation occurs in the zenith direction.

Providing rf power to input port 415 results in vertically polarized, four-lobed radiation in the horizon direction. This is because hybrid junctions 410, 408 and 409 provide equal powers that are in alternating phase at output ports 403, 405, 404 and 406. As a result, exciters c, d, e, and f supply rf excitation to the concentric aperture 302 resulting in vertically polarized, four-lobed radiation in the horizon direction.

Transmission lines 602 and 603 provide two additional modes of excitation of the concentric aperture 302. In this invention, these two modes are used as auxiliary excitation to improve the radiation pattern of antenna 200 when operating with power applied to input ports 411 or 412. In effect, the radiation pattern provided during primary excitation of the central aperture 301 can be modified by an auxiliary excitation of the concentric aperture 302 to provide improved radiation in a particular direction.

FIGS. 6A–6F illustrate six configurations for the optimization circuit 420 that affects the auxiliary excitation through transmission line 602. Optimization circuit 421 is a mirror image of circuit 420 and similarly affects the auxiliary excitation through transmission line 603. Since the two circuits are identical, only one of them will be discussed.

Figure 6A:
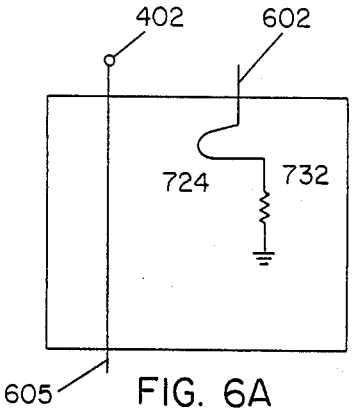
FIGS. 6A, 6B, 6C, 6D, 6E and 6F illustrate resistive termination, short circuit termination, frequency dependent termination, matched line, directionally coupled, and branch line coupled auxiliary excitation optimization circuits, respectively, which may be used in combination with an antenna according to the invention.

FIG. 6A shows a configuration in which transmission line 602 is connected to a terminating resistor 732, and port 414 is eliminated. Power coupled from the radiating central aperture 301 into concentric aperture 302 and appearing in transmission line 602 is absorbed or partially reflected by resistor 732 depending upon its resistance. The impedance of the resistor as modified by the transmission line length adjustment 724 and the network line length back to the concentric aperture 302 determines how this coupled power generates the auxiliary excitation of aperture 302 and thus how the antenna radiation pattern is affected when power is applied to input ports 411 or 412. One choice of resistance that may provide a desired radiation pattern is such that all of the power coupled from the central aperture 301 into concentric aperture 302 and appearing in line 602 is absorbed by resistor 732. Other choices of resistance together with line length 724 may improve the pattern in particular directions.

Figure 6B:
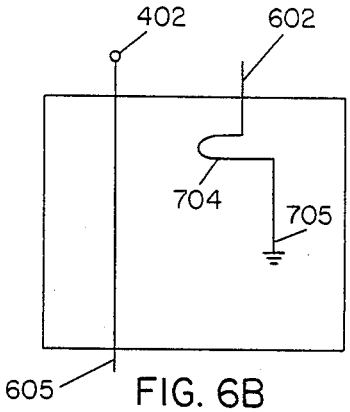

The configuration illustrated in FIG. 6B provides a short circuit in place of the resistive termination illustrated in FIG. 6A. The length of transmission line 704 is selected to improve the radiation pattern. One choice of line length is such that an effective short circuit is placed at the concentric aperture 302 in the aperture mode corresponding to transmission line 602. This choice will tend to make the concentric aperture 302 have minimum distorting effect on the radiation pattern of central aperture 301. Other choices of line length may improve the radiation pattern.

Figure 6C:
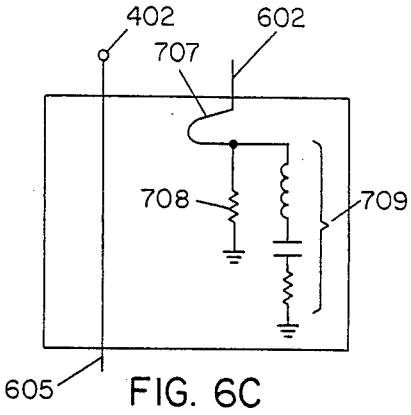

The configuration illustrated in FIG. 6C provides a frequency selective termination. At the resonant frequency of RLC circuit 709, the effective terminating resistance is equal to the parallel combination of the resistor 708 and the resistor in 709. If the resistor in 709 has zero resistance, then the effective terminating impedance is a short circuit at the resonant frequency of 709. At frequencies far from the resonant frequency of 709, the effective terminating resistance is approximately equal to the resistance 708. Optimization of the radiation pattern at one or more frequencies may be obtained with this frequency selective termination.

Figure 6D:
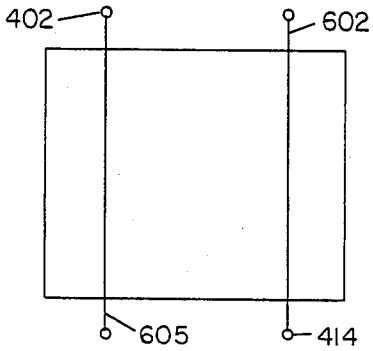

The configuration illustrated in FIG. 6D provides input port 414 directly connected to transmission line 602. Access to input port 414 and corresponding input port 416, which is directly connected to transmission line 603, allows the antenna to provide an additional two radiation pattern modes. For this configuration of optimizing circuit 420 and 421, adjustment of the radiation pattern obtained when power is applied to input port 411 or 412 is unavailable. The radiation pattern resulting from this configuration corresponds to the pattern obtained with the configuration of FIG. 6A when resistor 732 has a resistance value that provides a matched termination to transmission lines 602 and 724. The radiation pattern resulting from the FIG. 6D configuration has substantially improved characteristics compared with the patterns obtained with prior art antennas that do not employ hybrid junctions 408 and 409 and does not provide transmission lines 602 and 603.

Figure 6E:
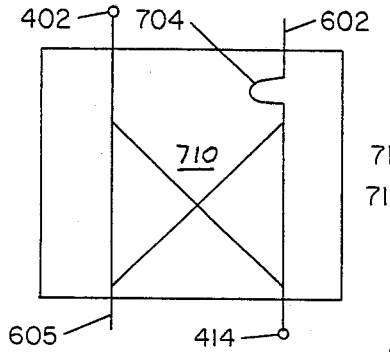

The configuration illustrated in FIG. 6E also provides an input port 414. However, in this case, a directional coupler 710 interconnects the transmission line 602 and the transmission line 605. When power is applied to input port 411 or 412, a fraction of the power is coupled from line 605 to line 602 by coupler 710. This coupled power in line 602 affects the auxiliary excitation of concentric aperture 302 and thus affects the radiation pattern. Adjustment to optimize this pattern is available by adjustment of the coupling coefficient of coupler 710 and by adjustment of the length of transmission line 704.

Figure 6F:
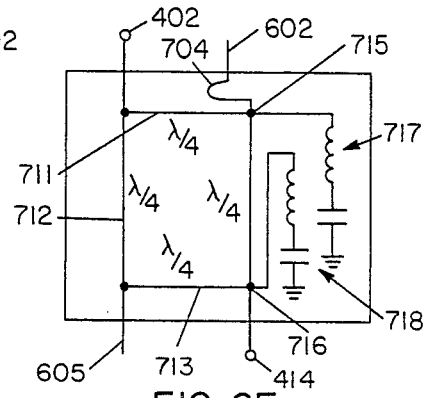

The configuration illustrated in FIG. 6F has a frequency selective circuit that provides intercoupling at one frequency and a terminating short circuit at another frequency. The circuit comprises a branch-line directional coupler formed by quarter wavelength transmission lines 711, 712, 713 and 714 which is connected at points 715 and 716 to two LC resonant circuits 717 and 718, respectively. At the resonant frequency of 717 and 718, a short circuit termination of line 602 occurs. At a frequency far from this resonant frequency, the directional coupler operates to couple a fraction of the power applied to port 411 or 412 into line 602. Optimization of the radiation pattern at more than one frequency may be obtained with this frequency selective circuit.

Figure 7:
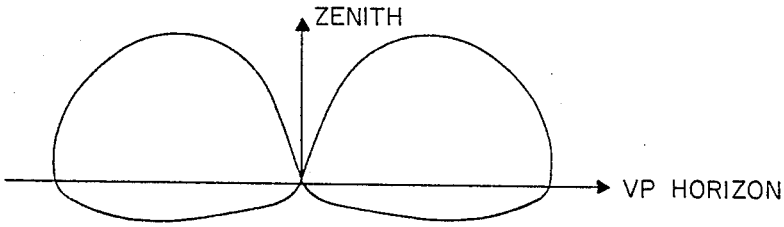
FIG. 7 is an elevation pattern diagram port 413 of FIG. 5 of the antenna according to the invention.
Figure 8:
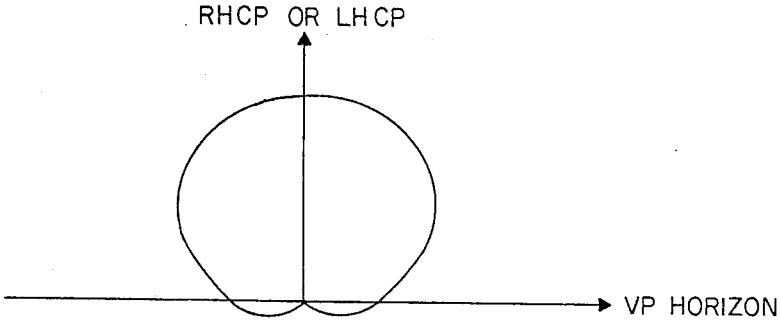
FIG. 8 is an elevation pattern diagram for a port feeding a central aperture surrounded by a concentrix aperture.
Figure 9:
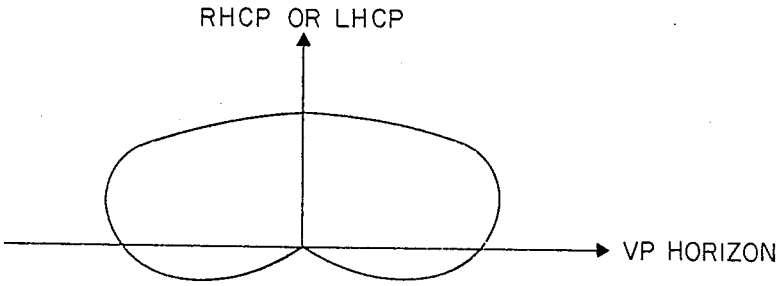
FIG. 9 is an optimized elevation pattern diagram for ports 411 or 412 of FIG. 5 of the antenna according to the invention.

FIG. 7 to 9 show elevation-plane radiation patterns that are omnidirectional in the azimuth plane. FIG. 7 shows a pattern that provides strong vertically-polarized (VP) radiation in the horizon direction and a null in the zenith direction. This monopole-like pattern is provided by a conventional annular-slot antenna and also by the multimode antenna system described herein when power is applied to port 413.

FIG. 8 shows a pattern providing strong right-hand or left-hand circular polarization (RHCP or LHCP) in the zenith direction but weak vertically-polarized radiation in the horizon direction. This prior art pattern is likely to occur when a conventional annular-slot antenna is placed concentric around a circularly-polarized flush antenna that originally provided strong vertically-polarized radiation in the horizon direction. This pattern is unacceptable because strong radiation in the horizon direction is desired for top-mounted aircraft antennas that communicate with satellites that may be located at low elevation angles.

FIG. 9 shows a pattern providing adequate right-hand or left-hand circular polarization in the zenith direction and strong vertically-polarized radiation in the horizon direction. The multimode antenna described herein can provide this desired pattern by means of auxiliary excitation of the concentric multimode aperture, when the central aperture is excited from ports 411 or 412. The multimode antenna can simultaneously provide the monopolelike pattern shown in FIG. 7, when the concentric aperture is excited from port 413. Additional patterns may be simultaneously available from ports 415, 414 and 416, as discussed above.

While there have been described what are at present considered to be the preferred embodiments of this invention, it will be obvious to those skilled in the art that various changes and modifications may be made therein without departing from the invention and it is, therefore, aimed to cover all such changes and modifications as fall within the true spirit and scope of the invention.

What is claimed is:

1. A flush mounted, multimode antenna system using a plurality of apertures, said system comprising:

(a) first aperture means, for providing at least two radiation pattern modes;

(b) second aperture means, concentric with said first aperture means, for and providing at least two radiation pattern modes;

(c) first feed system for exciting said first means;

(d) second feed system for exciting said second means; and (e) circuit means associated with said second feed system, for providing an auxiliary excitation to said second aperture means resulting in an optimized radiation pattern obtained during excitation of the first aperture means.

2. The antenna system of claim 1 wherein said second aperture means comprises a multimode annular aperture which surrounds said first aperture means and provides at least three radiation pattern modes.

3. The antenna system of claim 2 wherein said first aperture means comprises two intersecting and perpendicular apertures.

4. The antenna system of claim 2 wherein said first aperture means comprises a circular aperture.

5. The antenna system of claim 2 wherein said first aperture means comprises a square aperture.

6. The antenna system of claim 1 wherein said second aperture means comprises at least four apertures in a box array.

7. The antenna system of claim 1 wherein said second aperture means comprises a multimode square aperture.

8. The antenna system of claim 1 wherein said first aperture means comprises at least two intersecting and perpendicular apertures.

9. The antenna system of claim 1 wherein said first aperture means comprises a circular aperture.

10. The antenna system of claim 1 wherein said first aperture means comprises a square aperture.

11. The antenna system of claim 1 wherein said circuit means includes circuit impedance elements associated with and providing impedance for said second feed system.

12. The antenna system of claim 1 wherein said circuit means comprises interconnecting means for interconnecting said first and second feed systems and for coupling signals between said feed systems.

13. The antenna system according to claim 1 wherein said circuit means comprises interconnecting means for interconnecting said first and second feed systems and for coupling signals between said feed systems, said circuit means further including impedance means associated with and providing impedance for said second feed system.

14. The antenna system according to claim 1 wherein said first feed system comprises first and second coupled feed lines and said second feed system comprises a sum and difference network of transmission lines and wherein said circuit means comprises a first optimizing circuit connected to one of the transmission lines of said network and a second optimizing circuit connected to another of the transmission lines of said network.

15. The antenna system of claim 14 wherein said second aperture means comprises a multimode annular aperture which surrounds said first aperture means and provides at least three radiation pattern modes.

16. The antenna system according to claim 15 wherein said first aperture means includes first and second exciters and said annular aperture includes first, second, third and fourth exciters.

17. The antenna system according to claim 16 wherein said first feed system comprises a coupler having first and second inputs, and having a first output connected to the first exciter and having a second output connected to the second exciter.

18. The antenna system according to claim 17 wherein said second feed system comprises first, second and third hybrids each having sum and difference inputs and first and second outputs; the sum and difference inputs of the first hybrid, the sum input of the second hybrid and the sum input of the third hybrid for each receiving a signal to be radiated; the first output of the first hybrid connected to the sum input of the second hybrid; the second output of the first hybrid connected to the sum input of the third hybrid; the first and second outputs of the second and third hybrids being connected to the first, second, third and fourth annular exciters, respectively.

19. The antenna system of claim 18 wherein said first optimizing circuit is connected to the difference input to the second hybrid and wherein the said second optimizing circuit is connected to the difference input of the third hybrid.

20. The antenna system of claim 18 wherein said first optimizing circuit comprises a transmission line interconnecting the first output of the coupler and the first central exciter and a resistive termination connected to the difference input of the second hybrid.

21. The antenna system of claim 18 wherein said first optimizing circuit comprises a transmission line interconnecting the first output of the coupler and the first central exciter and a short circuit termination connected to the difference input of the second hybrid.

22. The antenna system of claim 18 wherein said first optimizing circuit comprises a transmission line interconnecting the first output of the coupler and the first central exciter and a frequency selective termination connected to the difference input of the second hybrid.

23. The antenna system of claim 18 wherein said first optimizing circuit comprises a second coupler having a first input connected to the output of the first coupler, a second input for receiving signals to be radiated, a first output connected to the first central exciter and a second output connected to the difference input of the second hybrid.

24. The antenna system of claim 18 wherein said first optimizing circuit comprises a quarter-wave transmission line bridge having a first input connected to the output of the first coupler, a second input for receiving signals to be radiated, a first output connected to the first central exciter and a second output connected to the difference input of the second hybrid, said second input and said second output of said bridge being connected to grounded LC terminating circuits.

25. The antenna system of claim 18 wherein said first optimizing circuit comprises a first matched transmission line interconnecting the output port of the first coupler and the first central exciter and a second matched transmission line having one end for receiving signals to be radiated and having the other end connected to the difference input of the second hybrid.

26. A flush mounted, multimode antenna system having a plurality of apertures located in an aperture surface, said system comprising:

(a) a central first aperture providing first and second radiation pattern modes which are respectively right hand and left hand circularly polarized in a radiation direction perpendicular to the aperture surface;

(b) a concentric second aperture surrounding said first aperture and providing first, second and third radiation pattern modes that are respectively an omni directional pattern that is vertically polarized in a radiation direction parallel to the aperture surface and two other modes having radiation patterns which are respectively right and left hand circularly polarized in a radiation direction perpendicular to the aperture surface;

(c) a first feed system connected to and exciting said first aperture;

(d) a second feed system connected to and exciting said second aperture; and (e) a circuit means connected to said second feed system to provide an auxiliary excitation to the second aperture resulting in optimized, vertically polarized radiation in the radiation direction parallel to the aperture surface during excitation of the first or second radiation pattern modes of the first aperture.

27. The antenna system of claim 26 wherein said circuit means includes circuit impedance elements for providing an impedance for the second feed system.

28. The antenna system of claim 26 wherein said circuit means comprises interconnecting means for interconnecting said first and second feed systems and for coupling signals between said feed systems.

29. The antenna system according to claim 26 wherein said circuit means includes interconnecting means for interconnecting said first and second feed systems for coupling signals between said first and second feed systems, said circuit means further including impedance means associated with said second feed system and providing impedance for said second feed system.

* * * * *